US009412215B2

(12) United States Patent
Perkins

(10) Patent No.: US 9,412,215 B2
(45) Date of Patent: Aug. 9, 2016

(54) INTERCHANGEABLE AND CHANGEABLE SLIDER BLADE DISPENSING APPARATUS WITH ADJUSTABLE SAW TOOTH TROUGH TRAY

(71) Applicant: Jeffrey Michael Perkins, Fort Worth, TX (US)

(72) Inventor: Jeffrey Michael Perkins, Fort Worth, TX (US)

( * ) Notice: Subject to any disclaimer, the term of this patent is extended or adjusted under 35 U.S.C. 154(b) by 0 days.

(21) Appl. No.: 13/987,177

(22) Filed: Jul. 8, 2013

(65) Prior Publication Data

US 2015/0008239 A1 Jan. 8, 2015

(51) Int. Cl.

| | |
|---|---|
| ***G07F 11/38*** | (2006.01) |
| ***A47F 1/12*** | (2006.01) |
| ***G07F 11/64*** | (2006.01) |

(52) U.S. Cl.

CPC ..... *G07F 11/38* (2013.01); *A47F 1/125* (2013.01); *G07F 11/64* (2013.01)

(58) Field of Classification Search

CPC combination set(s) only.
See application file for complete search history.

(56) References Cited

U.S. PATENT DOCUMENTS

| | | | | |
|---|---|---|---|---|
| 316,363 | A | 4/1885 | Hough | |
| 2,174,712 | A | 11/1939 | Wamer | |
| 2,620,691 | A * | 12/1952 | Gould | 81/3.08 |
| 2,637,612 | A | 5/1953 | Wamer | |
| 2,943,900 | A * | 7/1960 | Van Brunt | 312/45 |
| 2,990,228 | A * | 6/1961 | Celler | 312/237 |
| 5,706,956 | A * | 1/1998 | Headrick et al. | 211/59.2 |
| 5,743,438 | A * | 4/1998 | Sokolnicki | 222/181.1 |
| 2002/0117462 | A1* | 8/2002 | Hung | 211/189 |
| 2014/0217041 | A1* | 8/2014 | Johnson et al. | 211/59.2 |

OTHER PUBLICATIONS

Model 35—Ideal Cabinets.
Model 55—Ideal Cabinets.
Model 85—Ideal Cabinets.
Ideal Operating Guide & Parts Catalog (2-1-54), pp. 4 to 5, 1-1 to 7-1, 11-1 to 12-1, 1-3 to 4-3, 7-3, and 8-4.
Ideal Operating Guide and Parts Catalog, Selective Venders, Beverage Coolers; by F.H. Dean, President, Revised Edition 2-1-54.

* cited by examiner

*Primary Examiner* — Gene Crawford
*Assistant Examiner* — Kelvin L Randall, Jr.
(74) *Attorney, Agent, or Firm* — Fulwider Patton LLP

(57) ABSTRACT

This invention relates to the re-design of the original Ideal Dispensing apparatus, U.S. Pat. No. 2,174,712, (1939) and U.S. Pat. No. 2,637,612, (1953). Stated patent design was a single serving, slideable type container dispensing apparatus, manually operated horizontally through slideable guideways that were permanently welded fixed, one size, guideways that included a simple pan/tray for containers, cans and cartons. The new design gives the all-around versatility with the new all metal individual interchangeable and adjustable guideway blades and a saw tooth trough tray that accommodates majority of sizes, and shapes cans, cartons and beverage containers to include neck-less, and tapered designs in todays marketplace. This said new apparatus with new trough tray magnifies a novel and unobvious design combining and optimizing the utilization of space and versatility, with ease of installation and adjustment. This is optimal for changing, adding to the guideway storage and dispensing of said containers regardless of container design.

14 Claims, 8 Drawing Sheets

(Top)

Combination Apparatus 1N-24NT

INTERCHANGEABLE AND CHANGEABLE SLIDER BLADE DISPENSING APPARATUS WITH ADJUSTABLE SAW TOOTH TROUGH TRAY

CROSS REFERENCE TO RELATED APPLICATIONS

Not Applicable

FEDERALLY SPONSORED RESEARCH

Not Applicable

NAMES OF THE PARTIES IN JOINT RESEARCH

Not Applicable

SEQUENCE LISTING OR PROGRAM

Not Applicable

OTHER PUBLICATIONS

Ideal Operating Guide and Parts Catalog, Selective Venders, Beverage Coolers; by F. H. Dean, President, Revised Edition 2-1-54

FIELD OF THE INVENTION

The present disclosure relates to refrigeration vending machines internal slideable guideway dispensing apparatus assembly which singularly dispenses in a horizontal direction manually, one size type container, that used (Prior Art) a fixed width size guideway as a uniform control within the rows for storing and sliding containers by their necks in-between the guideway spaces on their formed edges. My new design has interchangeable and changeable slider blade guideway, to enable the storing and sliding of said containers by their necks of all widths, including on their bottoms by way of the new interchangeable and adjustable saw tooth trough tray using the said blade guideway threaded bar support for attaching the four support legs. The combination of the said dispensing apparatus and said tray design gives ability to add or subtract the storage of many of the beverage bottles, cans, cartons; odd tapered shaped, no necks, or lipped containers that have been created for the beverage marketplace today without the need of having to create a new sized guideway apparatus for each different said container every time you want to change to a different variety of beverage.

BACKGROUND OF THE INVENTION PRIOR ART

In 1939 the Ideal Milk Bottle Company started fabricating a milk dispensing apparatus to offer an easier and convenient way of storing, cooling and thus dispensing milk containers to wholesale and retail customers. The dispensing apparatus was patented on Oct. 3, 1939, U.S. Pat. No. 2,174,712, by Ralph W. Warner, Almond C. Woodruff and Harold Smalley. (Prior Art) This was the beginning of multiple companies initiating new ideas to boost sales of their products. At that time, milk and other liquid consumables, may have been packaged in glass bottles and cardboard carton containers which escaladed the growth of our vast multi-billion dollar vending machine market that we have today. During this short period, Ideal Milk Company changed its name to Ideal Dispensing Company, and in the process began to manufacture dispensing machines for big name beverage companies. Another Ideal patent was completed in May 5, 1953, U.S. Pat. No. 2,637,612 by Ralph Warner and Harold Smalley, which was for a release mechanism used with paper carton dispensing. (Prior Art) This type of dispensing apparatus continued to be built through the 1950's, but was very limited through the years. As time progressed, the vending market gained momentum creating additional sales of beverage type products that in turn created the vending machine manufacturing market itself. Our research shows that by the 1950's the Ideal Dispenser Company, was one of the only companies that built the manual horizontal slideable guideway dispensing apparatus for their cooling machines. This vending machine could not contend with the competition that required the volumes of product needed to be contained in a machine and be automated at the same time. The uniqueness of selecting your soda pop, putting your money in the slot and choosing the desired flavor and brand, then manually sliding it through the guideway spaces to the delivery opening, then pulling up and out, was fun, but could not compete with the new world of vending machines that were becoming known for quickness and volume.

Another down fall to the original slideable guideway dispensing apparatus may have been that during its time in service it was designed for about four different sizes and shapes of containers, that were available in the 1940's and 50's. In order to accommodate the different neck sizes of containers, it was necessary to fabricate a completely new dispensing apparatus with a change in the width of the said guideway opening for each new desired size. The high expense and non-productive process was likely the main contributing factor that caused this type of a vending machine apparatus to be ineffective and therefore became obsolete as the era of mass volume vending machines took over the commercial market.

Over the past 60 years, the beverage industry has developed many different styles, sizes, shapes of beverage containers and many new beverage companies have entered the marketplace. This new interior design of said apparatus allows for the return of a popular vintage product; a classic item, made into a useable, memorable, and modern appliance. The baby boomer population in 2010 exceeded 40 million. This segment of our population remembers the Ideal Dispenser and long for the "good 'ol days". Vintage products are booming in the marketplace today and this new design of the frame and horizontal guide-way type dispensing apparatus, give opportunity to meet a demand. This new apparatus gives opportunity to bring back a vintage product, as a new and useful appliance to be used in a man cave, recreation room, office, patio, by pool, commercial or residential. Creation of this now useful appliance will fill a need, and help our economy by creating new jobs in manufacturing and retail sales and equally important create that wonderful nostalgic memory when life was simple—a day that most of us long for.

SUMMARY OF THE INVENTION

The former design of the slider blade dispensing apparatus was used through the 1960's. The apparatus had the vintage style slideable guideway manual technology, and also the welded fixed size dispensing apparatus. This controlled and allowed only specific neck sizes of beverage containers in individual rows. My new design of the interchangeable and changeable slider blade dispensing apparatus allows for the many various shapes and neck sizes of beverage containers that we have in today's marketplace and optimizes space efficiency within the cooling cabinet as a whole. It takes into account the predetermined maximum allowable space that can be utilized within the cooling cabinet's confines, giving each said guideway a specific amount of predetermined maximum space that allows the largest containers to be stored, and moved through the guideways to the delivery opening for dispensing. In addition to the new said slider blade, is the new interchangeable and adjustable saw tooth trough tray that will be utilized for cans, cartons, bottles of many various sizes; containers that have tapered necks, and other odd shapes said containers that sit upright. This said tray gives the total benefit of allowing the apparatus to hold the variety of said containers without fabricating a new said apparatus for each type of no neck type said container. This new reconfiguration and design has created excellent space addition and utilization. Further objects, features and advantages of the invention will be apparent from the following detailed description when taken in conjunction with the accompanying drawings.

DETAILED DESCRIPTION OF PREFERRED EMBODIMENTS OF THE INVENTION

The original Ideal Dispenser Model 85 cooler cabinet that was manufactured and sold to beverage companies (Prior Art) is now comprised of the new modified interchangeable and changeable slider blade dispensing apparatus, with trough tray. The overall product design with its nostalgic integrity is used, but with a new twist that the said new apparatus is used in, which will demonstrate its overall usefulness as a new classic-retro, but modern appliance.

Figure 1:
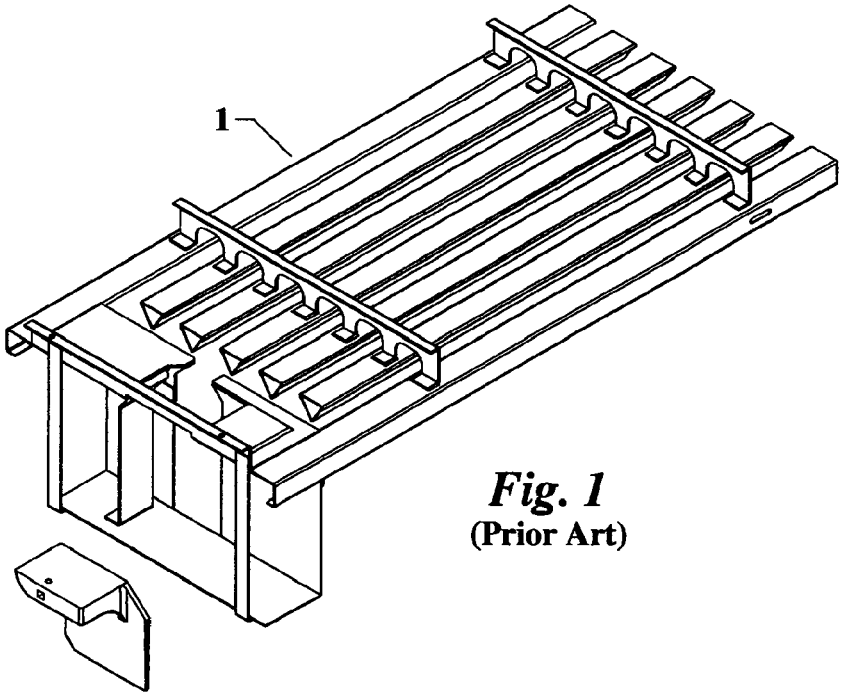
Fig. 1 (Prior Art)
FIG. 1, is the original slideable guideway dispensing apparatus frame assembly acquired when in production through the 1960's (Prior Art)
Figure 2:
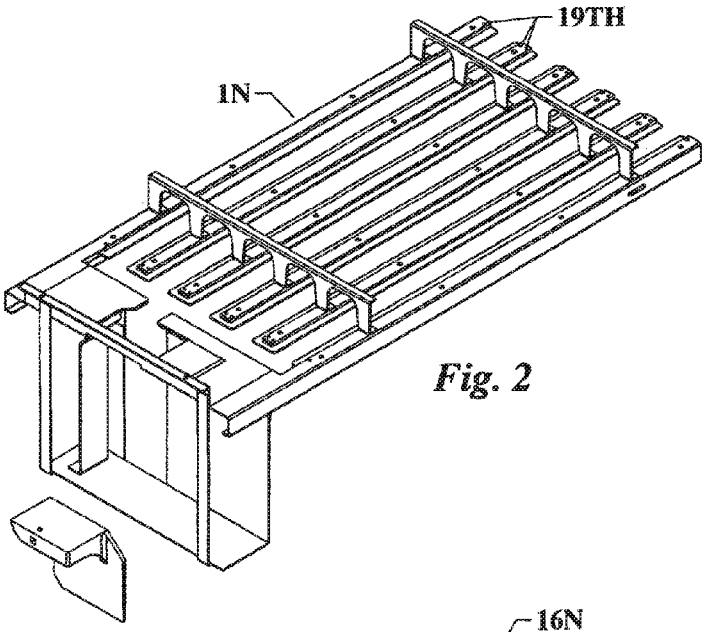
FIG. 2 (also referenced as FIG. 2-1N herein) is an isometric view of the new interchangeable and changeable slider blade dispensing apparatus, and FIG. 3 (also referenced as FIG. 3-1, herein) is a fragmentary isometric view of the last original production said apparatus with sequential numbers, letters relating to all the individual parts and areas that have been re-designed and modified according to the predetermined space required for many of the new containers being added (Prior Art)
Figure 13:
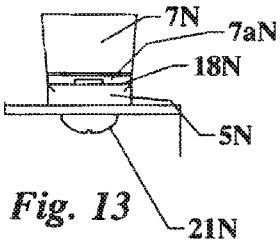
FIG. 13, is an end view of sub-assembly new slider blade guideway (-20N), part of the central FIG. 2-1N isometric view of the new slider blade dispensing apparatus, consisting of (-7N) bridge (-7*a*N) bridge foot, (-18N) spot weld area which connects—(5N) threaded bar support, attached is -20N) new guideway slider blade which is changeable with the (-21N) attaching fastener.
Figure 14:
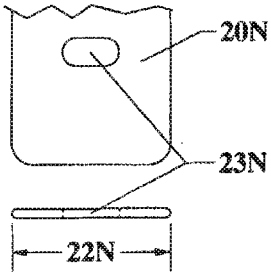
FIG. 14, is a top and end view of the new individual slider blade part (-20N), magnifying the slotted attaching and adjustment hole (-23N) and (-22N) shows that the blades are fabricated in different widths in pairs.

Milk Dispensing Apparatus original patent was Oct. 3, 1939, (Prior Art). The isometric view FIG. 1, (Pg. 1) is the dispensing apparatus frame assembly used up to 1960's, (Prior Art). Isometric view, FIG. 2-1N is the new modified interchangeable and changeable slider blade dispensing apparatus frame assembly that will be used to store and keep cold, the majority of different single serving beverage containers in today's marketplace. My new invention can easily enable the user to interchange and change the said blades for the different sizes of bottles; skinny, short, long, large, wide and even combining them which will be further identified and explained throughout this application.

The original Model 55 (A) used a guideway top plate (5) with an upside down L support in a fixed position for reinforcement and additional bottom clearance. (Prior Art) The next design, shown in Model 85 (B) details the (5) said plate with the V support (8) (Prior Art). The larger cabinet (C) was for additional storage of glass bottle containers, for said dispensing. These said apparatus's were of a fixed position and welded for specific size and style of said containers to be dispensed at a much larger scale (Prior Art).

Ideal adapted the Model 300 series for the combination of uses, with the intent to move Ideal into the increasing and demanding commercial market to stay competitive. The isometric views (C) through (F) shows a pan/tray (6P) under the guideways; (F) apparatus illustrates the total combining bottles, cans, cartons together (Prior Art). The plurality of guideway rows for the specific size said bottles could not be changed, but a pan/tray (#6P Catalog, Prior Art) was added to contain them and allow cans and cartons, the cartons being of a waxed cardboard structure, to be moved on their bottoms to the delivery opening. The height adjustment was relatively easy in that era since the different containers offered were all fairly standard in size, but today that is not the case. This will be covered further along in this application.

Figure 3:
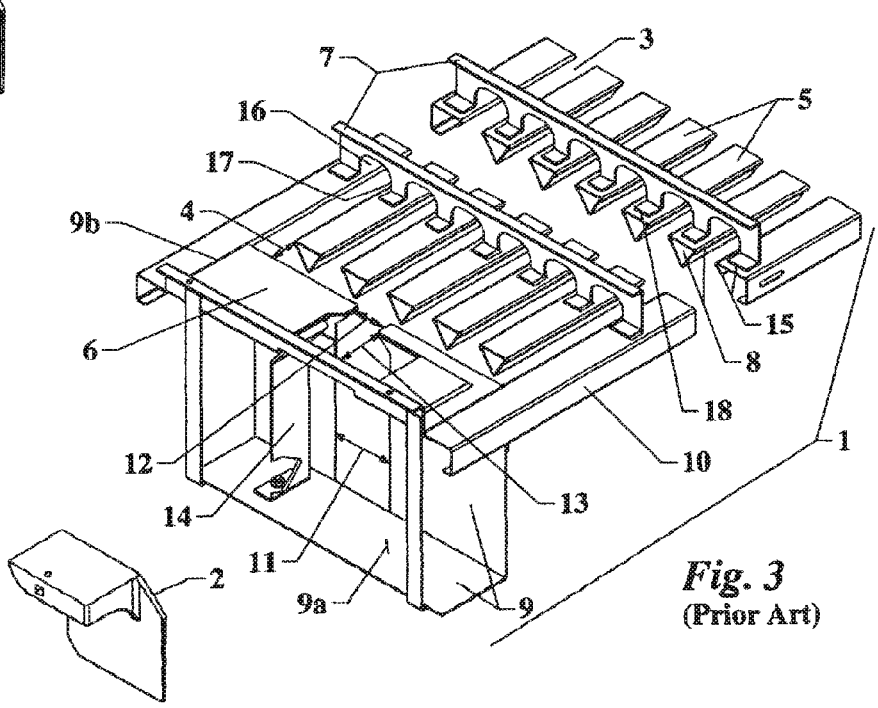
Fig. 3 (Prior Art)

On sheet 2, FIG. 3-1 shows the original said apparatus (Prior Art) and FIGS. 2-1N and 4-1 N shows the new said apparatus, where both indicate the appropriate numbers, letters relating to all the individual parts and areas that were original and those that have been redesigned. The letter (N) added for enhanced clarity that will be used throughout this application.

Figure 6:
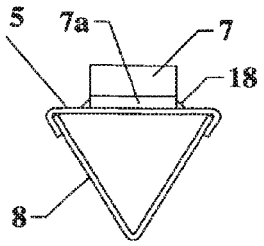
Fig. 6 (Prior Art)
FIG. 6, shows the original guideway part sub-assembly (-8) combining all of its pieces and connections together into one sub-assembly, which makes up seven such guideways to become one entire (-1) apparatus.
Figure 7:
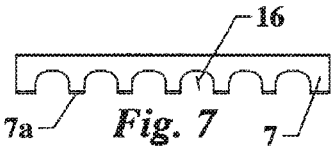
Fig. 7 (Prior Art)
FIG. 7, bridge part (-7) with plurality of (-5 & -8) said guideways, welded in concert with one another to (-7*a*) each bridge foot (Prior Art)
Figure 11:
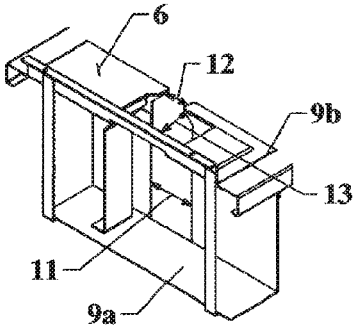
Fig. 11 (Prior Art)
FIG. 11, is the delivery angle support sub-assembly shown as a fragmentary isometric view demonstrating (-9*a*, 11, 12 and 13) areas of change.
Figure 8:
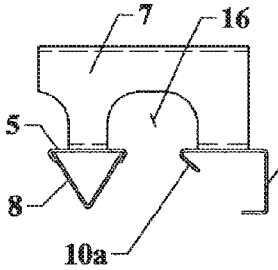
Fig. 8 (Prior Art)
FIG. 8, is a fractional end view showing the connection of parts FIG. 7 (-7), detailed (16) said archways small space, FIG. 6, (-5 & -8) with magnification to FIG. 8 (-10*a*) tail combination stiffener of said guideway, which will be addressed further.
Figure 9:
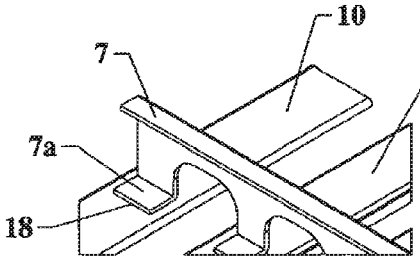
Fig. 9 (Prior Art)
FIG. 9, is a fragmented isometric view of said bridge part (-7) with one FIG. 6 said guideway sub-assembly in magnification showing FIG. 10 side rail frame part welded (-18) to (-7*a*) bridge foot, (Prior Art)
Figure 12:
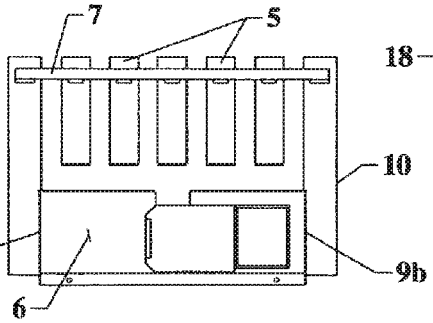
Fig. 12 (Prior Art)
FIG. 12, is a top forward fragmented view of the FIG. 11 said sub-assembly attached in concert with the said guideways (-8), side said supports (-10) and said bridges (-7) demonstrating the narrow container areas.
Figure 10:
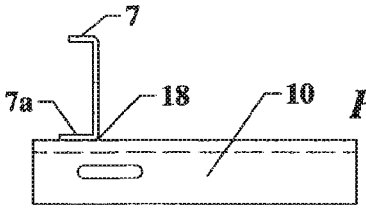
Fig. 10 (Prior Art)
FIG. 10, is a side view of the said rail frame support (-10) interconnected with (-7) bridge and (-7*a*) bridge foot welded (-18) together.

On Sheet 3, FIGS. 6 through 12 illustrate aspects of the prior art frame assembly of FIG. 3-1 which was an isometric view of the last original frame assembly (-1) of the Model 85 cooler that was previously manufactured. This prior art base platform is analogous to the embodiment of the assembly apparatus to be shown and described later in connection with, for example, FIGS. 2-1N and 13-20. FIG. 6 through FIG. 8 is the central point of the frame assembly of the prior Model 85, cooler. As will be discussed later in connection with, for example, FIGS. 2-1N and 13 through 20, re-design and modification of the prior art shown in FIGS. 3-1N and 6 through 12 has unlocked the hidden space required to organize and accommodate the many different containers used in today's marketplace, in one single apparatus. In the prior art apparatus shown in FIG. 6, the original guideway assemblies were made in two parts, (-5) plurality of top plates and (-8) plurality of V supports with interference fit went together, then welded (-18) to a plurality of (-7) bridge and archway feet (-7*a*). The delivery angle support dispensing mechanism subassembly shown in FIG. 11 is a fragmentary isometric sub-assembly view of the delivery area (-12) comprised of the mechanism area (-13), (-11) container body opening and (-9-*a*) the angle support. As will be described later, modifications which are not prior art include shifting of delivery top plate (-6) assembly over to the left side to accommodate the removal of one said guideway sub-assembly (-8) completely. FIG. 12 is a top view comprised of the side rail support (-10) attached to the delivery sub-assembly (9*a*) detailing (-9*b*) welds; FIG. 9 shows a rear corner fragmentary isometric view of the subparts assembled together; FIG. 10 is comprised of a side view of (-10) said support attached by weld (-18) to (-7) bridge foot (-7*a*) including the weld attachment of (-8) said guideway; FIG. 8 is an end view showing figure views (FIGS. 6, 9 and 10) magnifying (-7) bridge; (-16) details the lack of archway space was very small as said containers had very small caps and necks; the said bridge foot attach welded (-18) to the (-10) said support detailing the inside bent stiffener tail and guideway (-10*a*) of the prior art.

Figure 15:
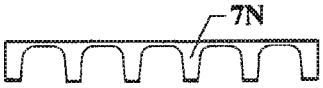
FIG. 15, is a front view of the new said bridge (-7N), with enlarged archways, tapered sides extended to the feet for additional added clearance.
Figure 16:
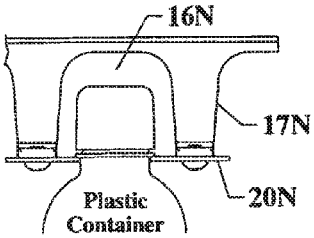
FIG. 16, is a fragmented front view showing the married individual parts as a said bridge assembly with said blade guideways and a current plastic bottle container supported in position, detailed (-16N) extra tall archway area, wide tapered (-17N) sides, (-20N) said blades capturing the underside neck lip of the said container.
Figure 18:
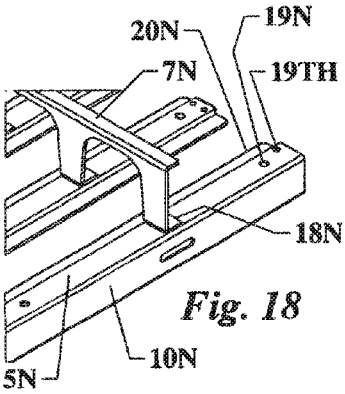
FIG. 18, (Pg.4) is a fragmented isometric view of the new said blade guideways and said support showing closer view of FIG. 2-1N containing; bridge (-7N), (-10N) and with (-5N) said bar support attached by weld (-18N), said blades (-20N) attached to (-5N) and (-10N) respectively, with details of threaded holes (-19N) for said blades (-20N) and threaded attachment holes (-19-1N) for trough tray legs.
Figure 17:
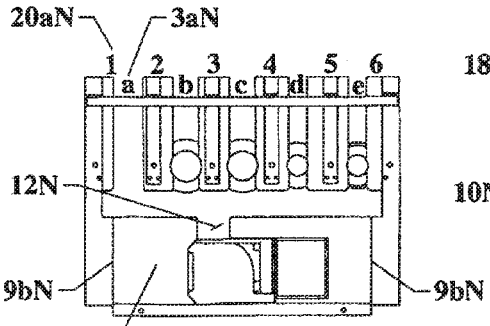
FIG. 17, is a more detailed top view similar to FIG. 12, exception being that this shows the predetermined utilization of the originally non-used space FIG. 12, adding the new designed additional parts of said blade guideways (20*a*N-1 to 6), detailing the different space said guideways (-3*a*N thru -3*e*N), including said containers hanging in position illuminating the different size necks and caps with points of reference to the delivery opening (-12N), the weld interconnection (9*b*N) of the said supports FIG. 19-10N to the top plate (-6N)
Figure 19:
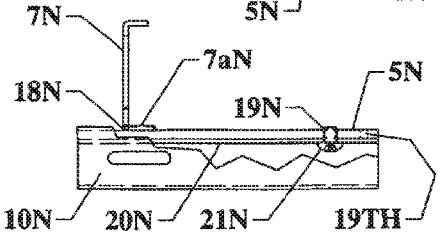
FIG. 19, is a side view of side frame support, similar view shown in FIGS. 17 & 18, clarifying the new stack-up of component parts used in said apparatus FIG. 2-1N as a whole, containing the said bridge foot (-7*a*N) welded (-18N) to the said side support (-10N) in which said bar (-5N) is welded (-18N) to the underside of said support (-10N) that shows (-19N) threaded hole for said blades (-20N) and (-19TH) threaded holes for trough tray legs, with (-20N) said blade attached with (-21N) attaching fastener.
Figure 20:
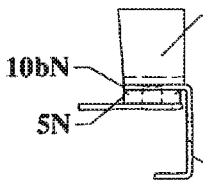
FIG. 20, end view of said support (-10N) and (-7N) bridge leg and foot welded to the (-10N) said support with the original tail (-10*a*) trimmed back (-10*b*N) to match the edge (-5N) said bar that is welded under (-10*b*N) for structure integrity. This becomes the outside guideway support for the said blade FIG. 19 (-20N) to be fastened with (-21N) fastener.
Figure 4:
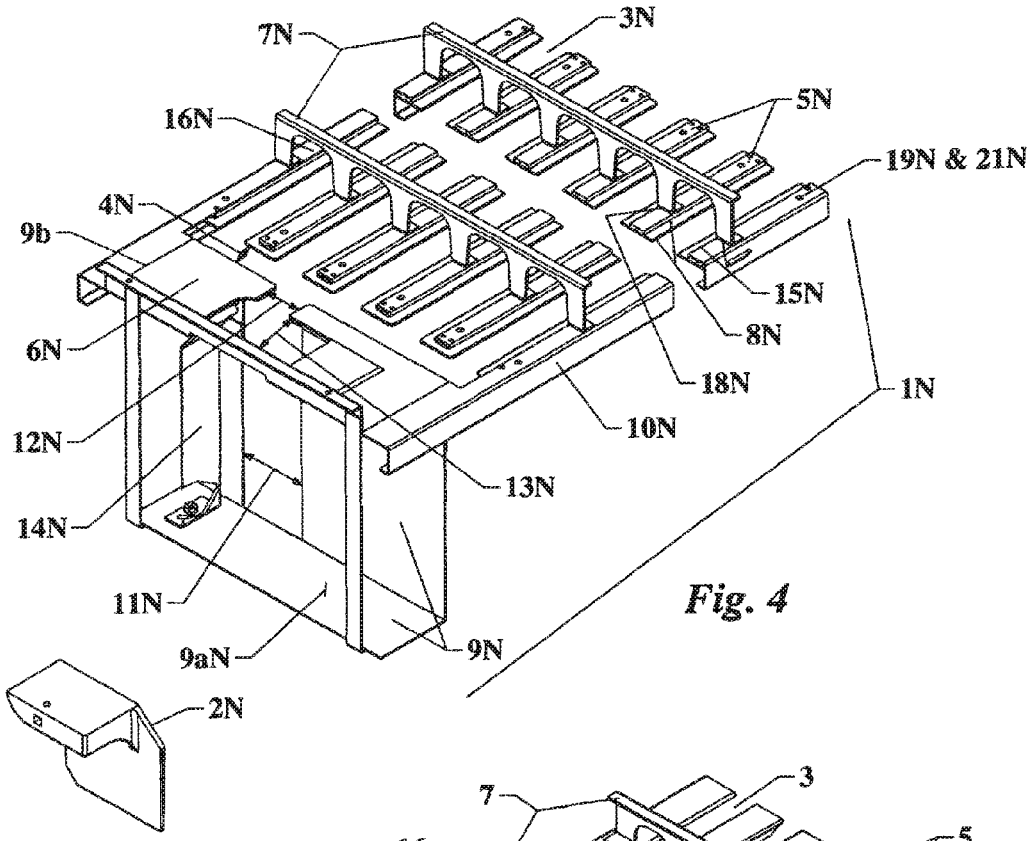
FIG. 4 (also referenced as FIG. 4-1N, herein) is a fragmentary isometric view of the new re-designed said apparatus with all the same sequential numbers, the letter "N" for "new" added relating to all the individual parts and areas that were located in the last known original said apparatus.
Figure 21:
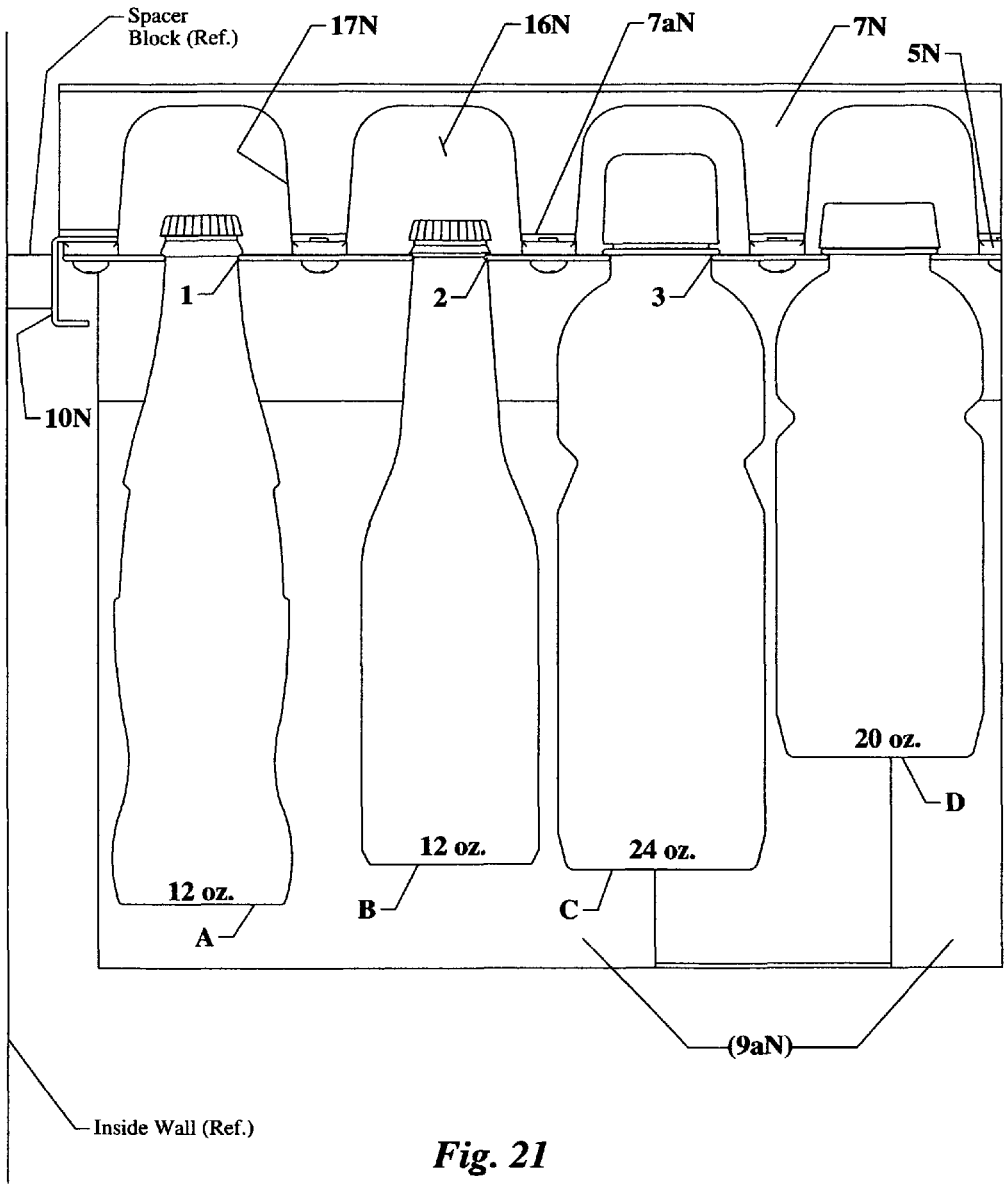
FIG. 21, is an end view from the rear of said apparatus FIG. 2-1N expanded in size, demonstrating some different said containers hanging in their respective positions, enhancing their different locations within each of the rows, magnifying the (-7N) bridge, (-16N) arch with the (-17N) sides tapering down to the said support bar (-5N) considerably opening the clearance space, that enhances the variety of said container cap sizes in relation to the neck widths and lips, including the shapes of the containers along with the body sizes, lengths (height) which magnify the different blade offsets to utilize the much added space acquired through this re-design and modification method.

This embodiment starting with sheet 4, FIG. 2-1N is an isometric view of the new invention, interchangeable and changeable slider blade dispensing apparatus frame assembly. The new slider blade will fit into many of the original Model 85 cooler and can be expanded as a larger apparatus or down sized to accommodate the small Model 35 and Model 55 original cabinets. Included are the fragmentary, isometric views of part assemblies, individual parts that comprise the new interchangeable and changeable slider blade dispensing apparatus frame that detail sub drawings starting with FIG. 13 that is comprised of (-7N) the plurality of new bridge legs and feet (-7*a*N) welded (-18N) to (-5N) a plurality of new threaded support bars, that allows the plurality of the new said blade (-20N) guides to be attached with (-21N) threaded fastener; below, FIG. 14 magnifies the (-20N) said blade, detailing the plurality of slotted attaching holes in each said blade (-23N) and showing that the plurality of said blades to enable different widths (-22N); in addition is FIG. 15 the front view of the new redesigned and expanded bridge (-7N) and FIG. 16 concludes that perspective well. FIGS. 15 & 16 shows the difference has optimally improved the said archway space; FIG. 16 is detailed front enlarged view that demonstrates the defined plurality of archways (-16N) in height and (-17N) the plurality of tapering sides from the top of said archway to the plurality of bridge feet (-7*a*N) adds more clearance for the many large or odd sized caps and neck sizes of bottle containers as this drawing depicts in FIG. 16 with a said bottle hanging by its neck lip in position denoting the position of the (-20N) said blade tips under the said neck lip. FIG. 17 a fragmented top view of the forward section of the said new apparatus FIG. 2-1N with a plurality of said bottle containers of different sizes and shapes stored in position to help magnify, along with marking the different aforementioned areas that have been predetermined by organizational space method calculations as to maximize storage space and dispensing space within the confines of a specific size cabinet. i.e. (ref. only) FIG. 1 (Prior Art); FIG. 19 is a side view of the material stack-up and details of the changes made, starting with the plurality of said feet (-7*a*N) welded (-18N) to the said side supports (-10N) that the plurality of threaded support bars (-5N) are welded (-18N) to the underside of the (-10N) said support, followed by the plurality of said blades (-20N) attached by the plurality of said fasteners (-21N); FIG. 20 an end view detail of the FIG. 16 showing the said tapering. (-17N) of bridge archway sides to the said feet. FIG. 19 (-7*a*N). FIG. 20, magnifying the said side support (-10N) with the stiffener tail (-10*b*N) trimmed off flush to the (-5N) that gains the most additional clearance available; Further detail in sheet 5, FIG. 21 is an enlarged end view of the new said apparatus, showing plurality of said blade guideways, (-5N) and side rail supports (-10N) in front of the backdrop of the angle support delivery opening assembly (-9*a*N) demonstrating the use of a plurality of different neck size and cap size said bottles. FIG. 21 (-A to -D) hanging in position on a plurality of said blade guideways denoting the different said blade widths offering the said interchangeability and changeable blades to the different said guideway locations taking in account the differences in bottle body widths to maintain the slideable clearance. The said blade edges (-1) (-2) and (-3) relate the locations under the lips of the different styles of said bottle containers. Another detail magnified, is the different offsets used with the said blades for this variety of said containers.

Figure 22:
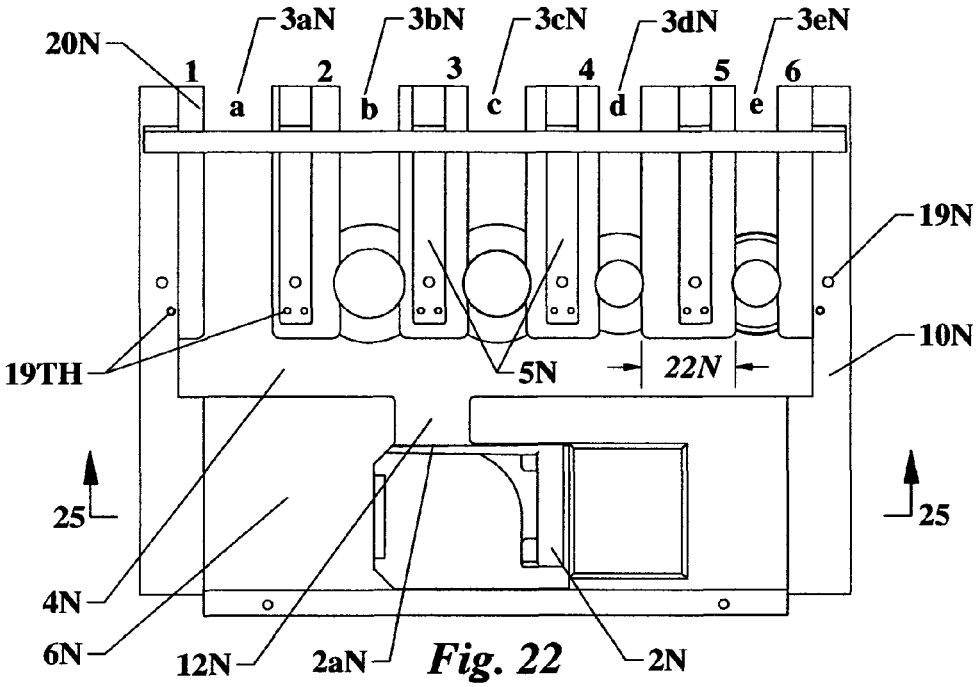
FIG. 22, is a top view expanded from FIG. 17, demonstrating a much clearer view of the different variety of bottles in position; between (-3*a*N) and (-3*e*N) is the different spacing to hold the different specific neck sizes and between (-20N-1) and (-20N-6) this shows the differences in blade widths (-22N) which through interchangeability and individually changing the said blades can be made to accommodate a variety of bottle sizes; this figure continues to point out the additional two said holes (-19TH) located in each end of the (-5N) said bar used for mounting the new Interchangeable and Adjustable Saw Tooth Trough Trays (-24NT); reference with (-12N) delivery opening with the rotating trap (-2N) in delivery and block position (-2*a*N) demonstrates as though there was a bottle being dispensed.
Figure 23:
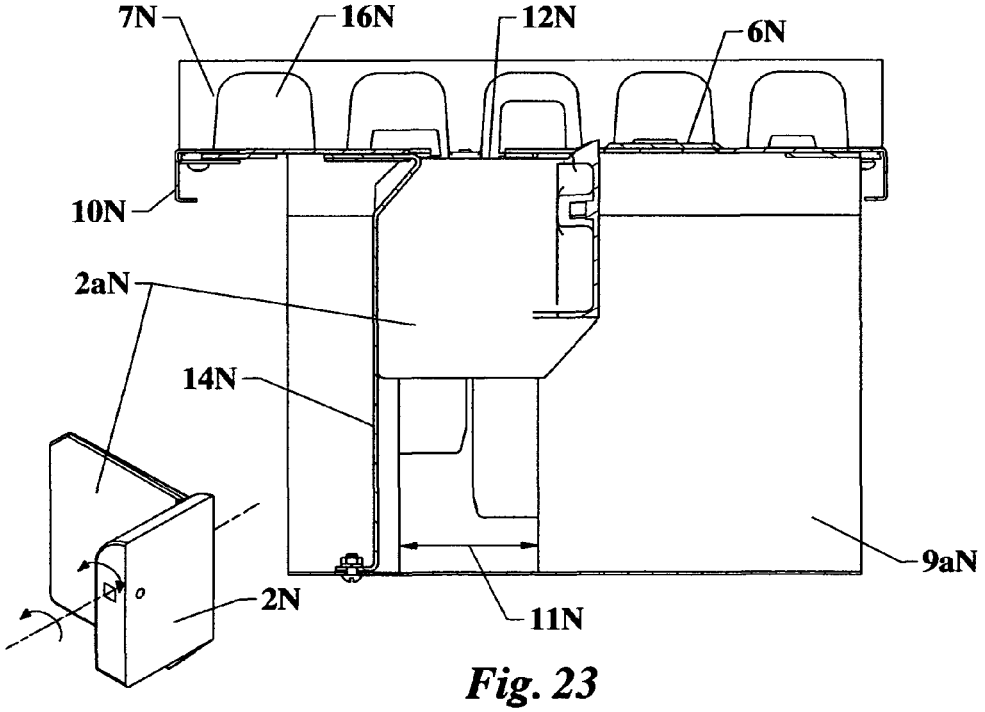
FIG. 23, the end view of FIG. 22 above that elaborates on the said trap (-2N) pointing to the rotation direction in a clearer view to detail what transpires during dispensing and shows through the delivery opening two said containers, in position to be moved forward through (-11N); (-2*a*N) demonstrates position of the blocking wing for delivery.

Embodiment of sheet, FIG. 22 and FIG. 23 highlights results of the method of re-design strategy, organizing, taking into account the known existing parts and areas identifying unused space and exact areas of modification with spaces that have been re-configured. FIG. 22, sectional top forward view of the said new apparatus (-1N) to elaborate in details as to the harmonious integration of all the said apparatus parts and pieces and reclaimed unused space being joined together; (-3*a*N) through (-3*e*N). Drawing depicts the culmination of unused space gained by removing one of the said guideways from the original apparatus FIG. 3-1 (-8). Improvement of overall maximum space width gain between each said guide support bar that allows for the enlarged body size of said containers, reference FIG. 21 to be stored next to one another as depicted by the plurality of said bottles in the foreground including the details of the plurality of said blades FIG. 22 (-20N). This magnifies both the different said blade widths (-22N) and the adjusted offset controlled by what size, shape of said bottle will be inserted into that particular row. Significant detail is the plurality of additional threaded holes (-19TH) located at each end of each said support bar (-5N) is for attaching the new Interchangeable and Adjustable Saw Tooth Trough Tray FIG. 24 (24NT) explained further along. Said holes (-19N) is for the attaching and adjustment of said blades (-20N). The adjacent pathway (-4N) is to the delivery opening (-12N) that is widened, into the delivery box opening area (-13N) that has been widened to the predetermined largest size container body able to be stored within the confines of the cabinet used; this accommodates the rotatable trap release (-2N) that also widens internally, that is in delivery position seen in FIG. 22. In FIG. 23 the operational rotation is expressed by the detailed arrows. The front forward view FIG. 23 enhances the new said bridge (-7N) detailing the space with the different size said bottle caps. (-9N) depicts the delivery sub-assembly to the closed position of the said trap (-2N) and the view of the lower portion of the widened (-11N) angle support opening (-9*a*N).

Figure 24:
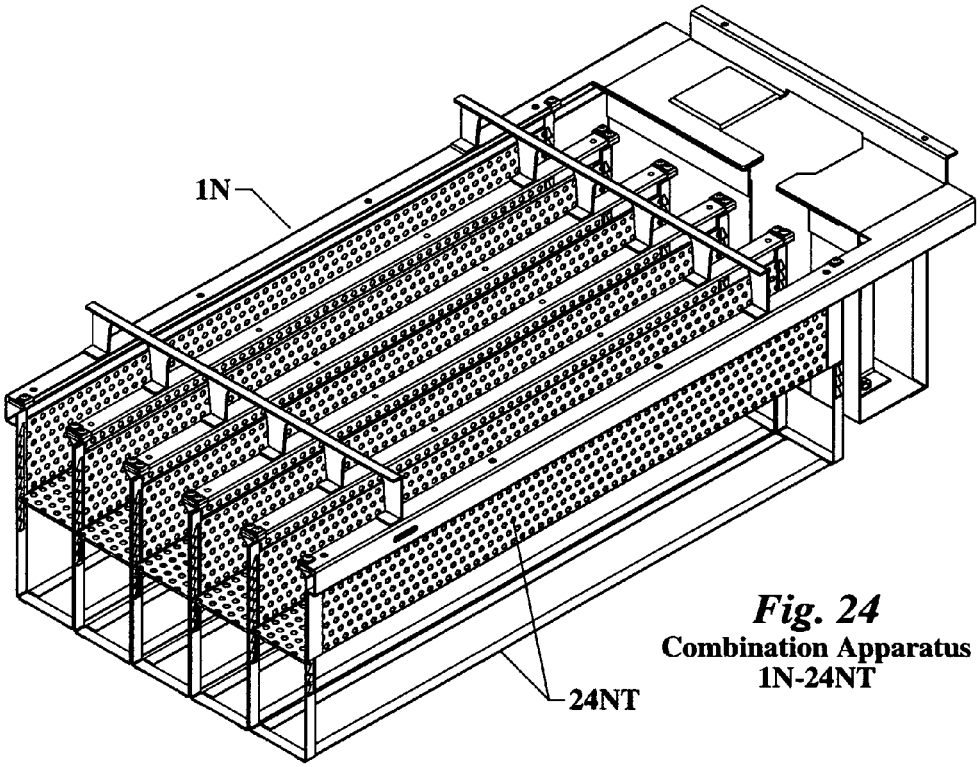
FIG. 24, is the introduction to the novel Interchangeable and Adjustable Saw Tooth Trough Tray (-24NT) that completes the ability for storage, holding and dispensing of the many other containers available such as cans, cartons, different bottle styles with no necks, including designs that are in a tapered form from there bottoms to their top, short or tall, round or square they all can be stored in this type of new said tray system, exclusive to this invention.
Figure 25:
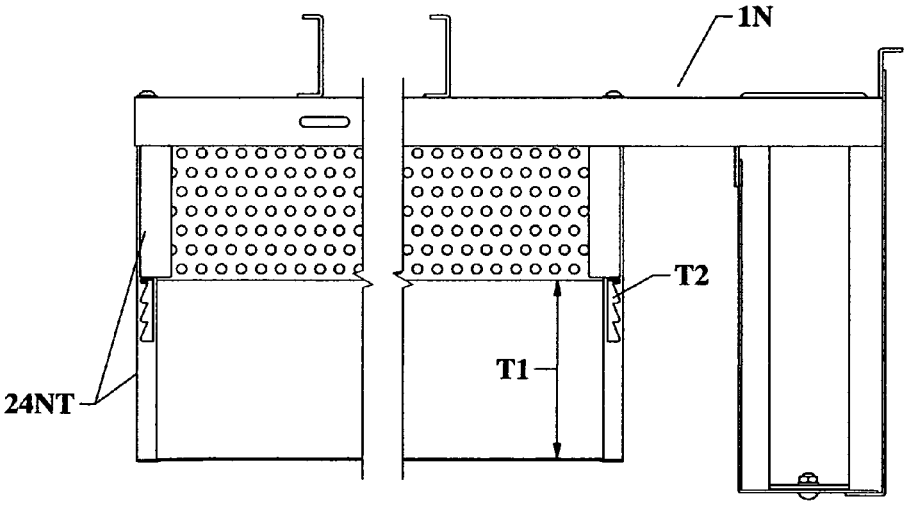
FIG. 25, is a fragmentary side view detailing the said tray (-24NT) mounted in one of the rows in the said apparatus (-1N) pointing out the (-T2) adjustable saw tooth notches and the distance of adjustment offered (-T1) which accommodates even the tallest of cans offered.

Sheet 7, FIG. 24 and FIG. 25 exhibits the new interchangeable and adjustable saw tooth trough tray (-24NT) that can be used for the many different containers that do not exhibit a neck lip or edge area as part of the container. FIG. 24 (1N-24NT) magnifies the use of another novel and unobvious design the said tray (-24NT) for the many without necks, containers, cans, cartons and the like, which highlights the simple versatility of this new additional optional said tray (-24NT) as part of the overall new said dispensing apparatus FIG. 24 (-1N-24NT) combined. The side view FIG. 25 demonstrates the simplicity of the integration of the two component assemblies, (25-1N) said apparatus for necked containers and (25-24NT) said tray for many of the without neck or odd shaped containers that need to sit upright. The new design gives versatility of adding one or a plurality of said trays (-24NT) at any time; this is continuity at its best. This view also shows detail to this significant assembly part (-24NT), the adjustment distance (-T1) the new saw tooth notches (-T2).

Figure 26:
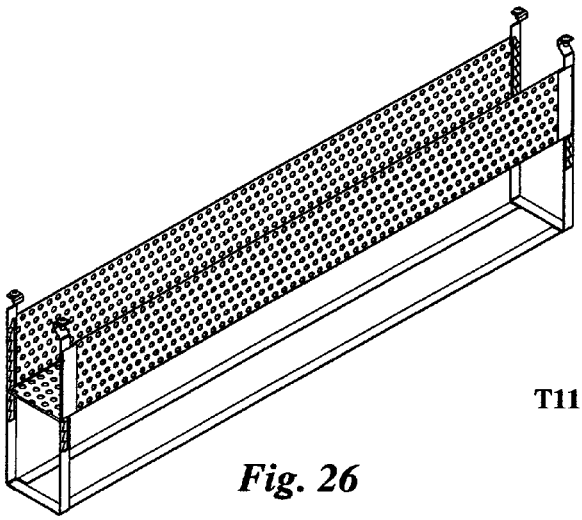
FIG. 26, is an isometric view of the said tray complete (-24NT) ready for use.
Figure 27:
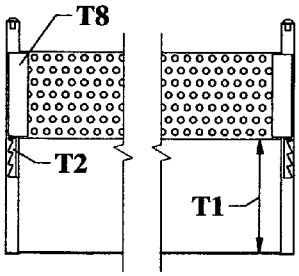
FIG. 27, is a fragmented side view of said tray including (-T8) guide plates on four corners with the sides showing the adjustment distance (-T1) and the adjustment notches.
Figure 28:
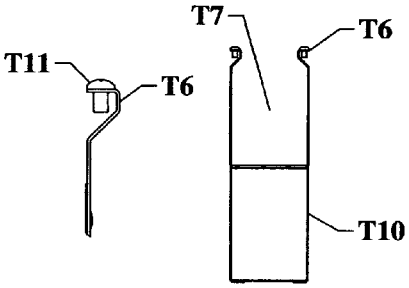
FIG. 28, is an end view showing (-T7) the inside space of the said tray (-24NT) that shows it's open at both ends used for loading and delivery, along with the support leg attach points located four places (-T6) and the fasteners (-T11) four places.
Figure 29:
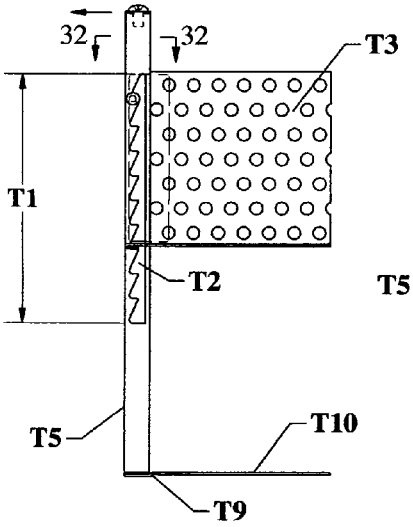
FIG. 29, is a fragmented side single end view magnified of said tray detailing the trays perforated metal two sides and one bottom (-T3), connected to a leg (-T5), the adjustment pin (-T4) saddled in the said notch (-T2) the frame (-T10) and (-T1) distance allowed.
Figure 30:
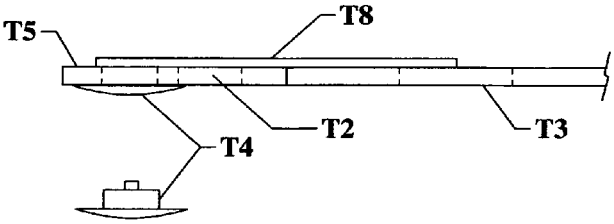
FIG. 30, is a turned top view of (-T5) leg assembly from FIG. 29 (-T5) showing the weld pin (-T4) separately and (-T4) in position within the (-T2) notches with the (-T8) guide plate covering the saw tooth notches (-T2). This is the stack-up of the simple lift to adjust mechanism.

In the above detailed description in accordance with sheet 8, FIG. 26 is the said tray as an assembly ready for installation at any one time with just a screw driver. FIG. 27 details the side view as before in FIG. 25 with the addition of the side scuff plates (-T8); FIG. 28 elaborates on (-T10) frame rails with the (-T6) attaching points, (-T7) which is the "U" shaped perforated trough container space opened at both ends for loading and unloading containers. (-T6) plurality of attaching points for the said tray allows it to hang from (-1N) said apparatus guideways, FIG. 22 (-5N) said bars attached by (-19TH) said holes with fasteners (-T11). Closer examination reveals in FIG. 29 the adjustment mechanism of the said tray, note; dotted line of (-T8) guide plates for clarity purposes. The plurality of hanging legs (-T5) have the predetermined number of saw teeth notches (-T2) which are laser cut in each leg for the right amount of height adjustment (-T1) allowing for (-T4) said pin to rest in. FIG. 30 is an enlargement showing the slideable side scuff plate of the said tray showing the pin (-T4) that is spot welded to the said plate with the top view portion of (-T5); to adjust said tray, lift from one end at a time and set into the next specific notch, repeating the step at the other end until the correct height is attained. The reversal is used for lowering the said tray (-24NT).

Today's market and technology of different useable new and improved materials is almost becoming an endless list. To highlight the most common used in production products today, plastics are the quickest and relatively the easiest to mass produce. Composites such as fiber glass, carbon fiber for its strength, less weight and many other variations of the said composites may be used. Carbon fiber also for its material pattern that shows up, is used as a design element or as a design style, ferrous and non-ferrous metals, such as steels, stainless steel, titanium; are very expensive compared to aluminum, brass, copper and the like; this product can be manufactured from some, all, or a combination of the said materials, but the most productive and cost effective is staying with the originality mild steel or stainless steel which is the highlight of this particular product. With the change from wet paint coatings and using powder coating materials just adds longevity just using these said materials over plastics, etc. is the main theme for this particular novel, unobvious, redesigned nostalgic retro-classic dispensing apparatus and cooler cabinet.

While one or more embodiments of the present invention have been illustrated in various degrees of detail, it will be clear to the skilled artisan, the herein the modifications and adaptations that discussed embodiments may be altered in various ways without departing from the scope or teaching of the present invention. It is the following claims, including all equivalents, which define the scope of the present invention.

REFERENCES CITED

| US PATENT DOCUMENTS; Dispensing Apparatus | | |
|---|---|---|
| 1) 2,174,712 | R. Warner, A. Woodruff and H. Smalley | Oct. 3, 1939 ( |
| 2) 2,637,612 | Ralph W. Warner | May 5, 1953 |
| | US PATENT DOCUMENTATION; Adjustable Saw Tooth Trough Tray | |
| 3) 316,363 | Horace C. Hough | Apr. 21, 1885 |

DRAWINGS

Figure Notes

The main drawing page figure use Roman numeral numbers, the closely related separate figures per page use capital alphabetic letters. The separate detailed part figures use the same numbers throughout this application document that start with the prior art original 1954 dispensing apparatus. The capital "N" has been added behind each part number to enhance clarity of the new modified slider blade dispensing apparatus main and individual components.

DRAWINGS

Reference Numerals

Original=# only; New=# & N; Re-designed/Modified=# & M; Cutaway figures=# & C

Figure 5:
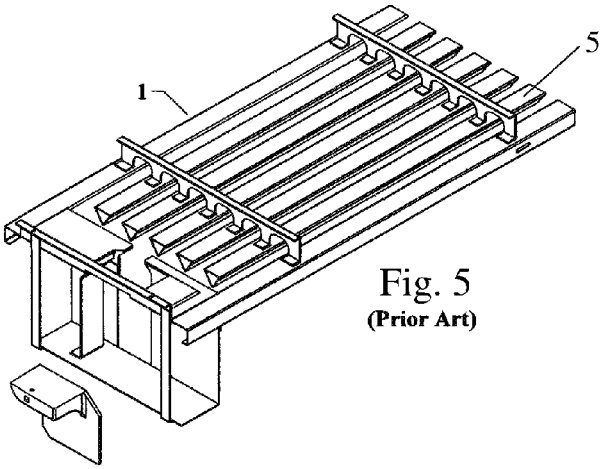
Fig. 5 (Prior Art)
FIG. 5 is a fragmentary view of a prior art beverage dispensing rack having a fixed structure for specific containers.

1 Last known original dispensing apparatus
1N New re-designed/modified slider blade interchangeable and changeable dispensing apparatus
2, 2N Trap release, rotatable
2*a*, 2*a*N Trap release, rotatable blocking wing
3, 3N Guide way container space width
3*a*N (a to e) New different space widths
3 (1 to 5) Bottle neck lip
4, 4N Front guide way space width
5 Original slideable guideway top plate
5N Threaded bar support
6, 6N Top plate to the dispensing mechanism sub-assembly
6P FIG. 5 Reference to the original optional pan/tray used for cartons
7, 7N Bridge, archway, leg support structure
7*a*, 7*a*N Bridge support foot
7*b*, 7*b*N Bridge support foot weld spots
8 Original slideable guide way V support
8N Blade slider guide way assembly
9, 9N Delivery angle support dispensing mechanism sub-assembly
9*a* Delivery angle panel support and cut out
9*a*N Delivery angle panel support and cut out added length
9*b*, 9*b*N Weld areas for Delivery angle support dispensing mechanism sub-assembly to each said rail support
10, 10N Side rail frame supports and slider guide way combination
11 Lower section width opening of delivery area
11N Lower section opening widened for new containers
12 Top entrance, delivery original opening for beverage container necks to pass
12N Top entrance, delivery opening new width for beverage container necks to pass
13, 13N Top width open area for trap release
14, 14N Container guide adjustable
15 Bridge foot and side frame support channel guide way area
15N Bridge foot and side frame support channel with threaded bar, blade guideway area
16, 16N Bridge open area archways
17, 17N Bridge tapered sides
18 Bridge foot weld to original guide way
18N Bridge foot weld to threaded bar support
19N Threaded hole, support bar
19TH Threaded holes 2 ea. at each end of support bar
20N Blade, slider guideway
20N (1-6) Blade guideway edges
21N Blade rail fastener
22N Blade rail width
23N Elongated adjustment hole
24NT Interchangeable and Adjustable Saw Tooth Trough. Tray Assembly
24NT—T1 Up and Down Adjustment Distance
T2 Saw Tooth incremental teeth notches
T3 Perforated material used
T4 Pin to locate and maintain height increments
T5 Trough legs
T6 Frame offset holding tabs (4 plcs)
T7 Inside area and open ends of U shaped trough T8 Outside guide plate
T9 Joggle, lower longitudinal frame supports
T10 Trough tray frame assembly
1N-24NT, Combination, Model 85 new dispensing apparatus and new Saw tooth trough tray.

The invention claimed is:

1. A dispensing apparatus having an adjustable saw tooth trough tray comprising:

a first side rail frame support;

a second side rail frame support;

at least two leg support structures, each one of said at least two leg support structures includes a plurality of bridge feet separated by a plurality of archways, said plurality of bridge feet extend downward from said leg support structure, an end of said at least two leg support structures are attached to said first side rail frame support, an opposing end of said at least two leg supports are attached to said second side rail frame support, wherein said first and second side rail frame supports are attached to a first mechanism support;

a plurality of tray frame supports, said plurality of tray frame supports are attached to said plurality of bridge feet;

a plurality of U-shaped trays, each one of said plurality of U-shaped trays includes a first side portion, a second side portion and a bottom portion, a retention pin extends from at least one of said first and second side portions;

a plurality of tray frames, each one of said plurality of tray frames includes a base member, a first pair of legs and a second pair of legs, said first pair of legs extend upward from a first end of said base member, said second pair of legs extend upward from a second end of said base member, a plurality of teeth notches are formed on said first and second pair of legs to receive said retention pin, wherein a position of one of said plurality of U-shaped trays is adjusted relative to one of said plurality of tray frames by resting said retention pins in said teeth notches.

2. The dispensing apparatus having an adjustable saw tooth trough tray of claim 1 wherein:

an offset holding tab extends from a top of said first and second pair of legs, said offset holding tab rests on a top of said plurality of tray frame supports.

3. The dispensing apparatus having an adjustable saw tooth trough tray of claim 2 wherein:

a location pin extends downward from said offset holding tab, a location hole is formed in said plurality of tray frame supports to receive said location pin.

4. The dispensing apparatus having an adjustable saw tooth trough tray of claim 1 wherein:

an end plate extends from each end of said first and second side portions, said retention pin extends from said end plate.

5. The dispensing apparatus having an adjustable saw tooth trough tray of claim 1 wherein:

at least one of said plurality of U-shaped trays is fabricated from a perforated plate.

6. A dispensing apparatus comprising:

a supporting frame having at least two leg support structures, wherein each leg support structure includes a plurality of bridge feet extending downward from said leg support structure;

a plurality of U-shaped trays, each one of said plurality of U-shaped trays includes a first side portion, a second side portion and a bottom portion, a retention pin extending from at least one of said first and second side portions of said U-shaped trays;

a plurality of tray frames, each one of said plurality of tray frames includes a base member, a first pair of legs and a second pair of legs, said first pair of legs extend upward from a first end of said base member, said second pair of legs extend upward from a second end of said base member, a plurality of saw-tooth notches are formed on said first and second pair of legs to receive said retention pin, wherein a position of each one of said plurality of U-shaped trays is adjustable relative to another one of said plurality of tray frames by resting said retention pins in said saw-tooth notches; and a plurality of tray frame supports, wherein at least one of said tray frame supports is attached to at least one of said plurality of tray frames, and at least one of said tray frame supports is attached to at least one of said plurality of bridge feet.

7. The dispensing apparatus of claim 6 further comprising:

a first side rail frame support;

a second side rail frame support;

at least two leg support structures, wherein each leg support structure includes a plurality of bridge feet extending downward from said leg support structure, wherein an end of each said leg support structure is attached to said first side rail frame support, and an opposing end of each leg support structure is attached to said second side rail frame support;

a plurality of tray frame supports, wherein at least one of said tray frame supports is attached to at least one of said plurality of tray frames, and at least one of said tray frame supports is attached to at least one of said plurality of bridge feet.

8. The dispensing apparatus of claim 6 further comprising: an offset holding tab extends from a top of said first and second pair of legs, said offset holding tab rests on a top of said plurality of tray frame supports.

9. The dispensing apparatus of claim 8 further comprising: a location pin extends downward from said offset holding tab, a location hole is formed in said plurality of tray frame supports to receive said location pin.

10. The dispensing apparatus of claim 6 further comprising: an end plate extends from each end of said first and second side portions, said retention pin extends from said end plate.

11. The dispensing apparatus of claim 6 wherein at least one of said plurality of U-shaped trays is fabricated from a perforated plate.

12. A dispensing apparatus comprising:

a first side rail frame support;

a second side rail frame support;

at least two leg support structures, wherein each leg support structure includes a plurality of bridge feet extending downward from said leg support structure, said bridge feet separated by a plurality of archways, wherein an end of each said leg support structure is attached to said first side rail frame support, and an opposing end of each leg support structure is attached to said second side rail frame support;

storing means for storing different-sized beverage containers, said storing means is attached to said plurality of bridge feet; wherein said storing means further includes:

a plurality of tray frame supports, said plurality of tray frame supports are attached to said plurality of bridge feet;

a plurality of U-shaped trays, each one of said plurality of U-shaped trays includes a first side portion, a second side portion and a bottom portion, a retention pin extending from at least one of said first and second side portions of said U-shaped trays;

a plurality of tray frames, each one of said plurality of tray frames includes a base member, a first pair of legs and a second pair of legs, said first pair of legs extend upward from a first end of said base member, said second pair of legs extend upward from a second end of said base member, a plurality of saw-tooth notches are formed on said first and second pair of legs to receive said retention pin, wherein a position of one of said plurality of U-shaped trays is adjusted relative to one of said plurality of tray frames by resting said retention pins in said saw-tooth notches.

13. A beverage container dispensing apparatus comprising:

a frame having at least two leg support structures, wherein each leg support structure includes a plurality of bridge feet extending downward from said leg support structure, said bridge feet separated by a plurality of archways;

storing means for storing different-sized beverage containers, said storing means is attached to said plurality of bridge feet; wherein said storing means further includes:

a plurality of tray frame supports attached to said plurality of bridge feet;

a plurality of U-shaped trays, each one of said plurality of U-shaped trays includes a first side portion, a second side portion and a bottom portion, a retention pin extending from at least one of said first from said first and second side portions of said U-shaped trays;

a plurality of tray frames, each one of said plurality of tray frames includes a base member, a first pair of legs and a second pair of legs, said first pair of legs extend upward from a first end of said base member, said second pair of legs extend upward from a second end of said base member, a plurality of saw-tooth notches are formed on said first and second pair of legs to receive said retention pin, wherein a position of one of said plurality of U-shaped trays is adjusted relative to one of said plurality of tray frames by resting said retention pins in said saw-tooth notches.

14. A beverage container dispensing apparatus comprising:

a frame having at least two leg support structures, wherein each leg support structure includes a plurality of bridge feet extending downward from said leg support structure, said bridge feet separated by a plurality of archways;

a plurality of tray frame supports attached to said plurality of bridge feet;

a plurality of U-shaped trays, each one of said plurality of U-shaped trays includes a first side portion, a second side portion and a bottom portion, a retention pin extending from at least one of said first and second side portions of said U-shaped trays;

a plurality of tray frames, each one of said plurality of tray frames includes a base member, a first pair of legs and a second pair of legs, said first pair of legs extend upward from a first end of said base member, said second pair of legs extend upward from a second end of said base member, a plurality of saw-tooth notches are formed on said first and second pair of legs to receive said retention pin, wherein a position of one of said plurality of U-shaped trays is adjusted relative to one of said plurality of tray frames by resting said retention pins in said saw-tooth notches.

* * * * *